US010744807B2

(12) United States Patent
Gervais et al.

(10) Patent No.: US 10,744,807 B2
(45) **Date of Patent: *Aug. 18, 2020**

(54) MICROWAVE DRYERS FOR PRINTING SYSTEMS THAT UTILIZE ELECTROMAGNETIC AND RADIATIVE HEATING

(71) Applicants: Bryan Giroux Gervais, Loveland, CO (US); Andrew David Norte, Westminster, CO (US)

(72) Inventors: Bryan Giroux Gervais, Loveland, CO (US); Andrew David Norte, Westminster, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/129,146

(22) Filed: Sep. 12, 2018

(65) Prior Publication Data

US 2019/0009605 A1 Jan. 10, 2019

Related U.S. Application Data

(63) Continuation of application No. 15/435,978, filed on Feb. 17, 2017, now Pat. No. 10,099,500.

(51) Int. Cl.
*B41M 7/00* (2006.01)
*F26B 3/347* (2006.01)
(Continued)

(52) U.S. Cl.
CPC ..... *B41M 7/0081* (2013.01); *B41F 23/0493* (2013.01); *F26B 3/347* (2013.01);
(Continued)

(58) Field of Classification Search
CPC ... B41M 7/0081; B41F 23/0493; F26B 25/06; F26B 3/347; F26B 13/145; B41J 11/002
See application file for complete search history.

(56) References Cited

U.S. PATENT DOCUMENTS 5,111,012 A * 5/1992 Hyun ..... F24H 3/062 219/757
5,423,260 A * 6/1995 Goldberg ..... B41F 23/0493 101/424.1

(Continued)

OTHER PUBLICATIONS

IP.com search (Year: 2019).*

(Continued)

*Primary Examiner* — Lisa Solomon
(74) *Attorney, Agent, or Firm* — Duft & Bornsen, PC

(57) ABSTRACT

Microwave dryers and a method of fabricating microwave dryers are disclosed. The microwave dryers include a microwave source that generates electromagnetic energy to dry a wet colorant applied to a continuous-form print medium. The microwave dryers further include a microwave waveguide electromagnetically coupled to the microwave source that transports the electromagnetic energy between a first end and a second end. The microwave waveguide includes a passageway that is sized to pass the continuous-form print medium through the microwave waveguide. The microwave dryer further includes a plurality of microwave absorbing elements within the microwave waveguide that absorb the electromagnetic energy and heat the wet colorant.

22 Claims, 5 Drawing Sheets

(51) Int. Cl.

| | |
|---|---|
| ***F26B 13/14*** | (2006.01) |
| ***F26B 25/06*** | (2006.01) |
| ***B41F 23/04*** | (2006.01) |
| ***B41J 11/00*** | (2006.01) |

(52) U.S. Cl.
CPC ..... *F26B 13/145* (2013.01); *F26B 25/06* (2013.01); *B41J 11/002* (2013.01)

(56) References Cited

U.S. PATENT DOCUMENTS

| | | | | |
|---|---|---|---|---|
| 9,258,850 | B2 * | 2/2016 | Yoshikado ..... | H05B 6/6402 |
| 10,099,500 | B2 * | 10/2018 | Gervais ..... | B41M 7/0081 |

OTHER PUBLICATIONS

Wikipedia Article: "Electromagnetic absorbers", Paragraph 1 (Year: 2018).*
Wikipedia Article: "Low-K dielectric" [Section: Low-K materials] (Year: 2019).*
IP.com search (Year: 2020).*

* cited by examiner

MICROWAVE DRYERS FOR PRINTING SYSTEMS THAT UTILIZE ELECTROMAGNETIC AND RADIATIVE HEATING

RELATED APPLICATIONS

The present application is a continuation of co-pending U.S. patent application Ser. No. 15/435,978, filed on Feb. 17, 2107, titled "MICROWAVE DRYERS FOR PRINTING SYSTEMS THAT UTILIZE ELECTROMAGNETIC AND RADIATIVE HEATING", which is hereby incorporated by reference.

FIELD OF THE INVENTION

The invention relates to the field of printing systems, and in particular, to microwave dryers that are used to dry liquid materials that are applied to a print media by the printing system.

BACKGROUND

Production printing systems for high-volume printing typically utilize a production printer that marks a continuous-form print medium (e.g., paper) with a wet colorant (e.g., an aqueous ink). After marking the continuous-form print medium, a dryer downstream from the production printer is used to dry the colorant applied to the continuous-form print medium. Microwave dryers may be employed as a dryer for a production printing system in some applications.

A microwave dryer utilizes microwave energy to heat the colorant to cause a liquid portion of the colorant to evaporate, thereby fixing the colorant to the continuous-form print medium. A microwave source directs the microwave energy down a long axis of a waveguide, and a passageway through the waveguide is sized to enable the continuous-form print medium to pass through the waveguide. As the continuous-form print medium traverses the passageway, the wet colorants applied to the continuous-form print medium are exposed to the microwave energy and are heated.

Due to the high speeds used in production printing systems, the amount of time that a particular portion of the continuous-form print medium is within the passageway can be short. To ensure that the colorant can be dried, the length of the waveguides may be extended and/or the number of waveguides may be increased and/or the power of the microwave energy used to dry the colorant may be increased. However, longer or more waveguides require more floor space in a production printing environment, and increasing the power of the microwave energy can add cost to the operation of the printing system.

SUMMARY

Microwave dryers and a method of fabricating microwave dryers are disclosed. The microwave dryers include a microwave source that generates electromagnetic energy to dry a wet colorant applied to a continuous-form print medium. The microwave dryers further include a microwave waveguide electromagnetically coupled to the microwave source that transports the electromagnetic energy between a first end and a second end. The microwave waveguide includes a passageway that is sized to pass the continuous-form print medium through the microwave waveguide. The microwave dryer further includes a plurality of microwave absorbing elements within the microwave waveguide that absorb the electromagnetic energy and heat the wet colorant.

One embodiment comprises a microwave dryer that dries a wet colorant applied to a continuous-form print medium by a printing system. The microwave dryer includes a microwave source that generates electromagnetic energy to dry the wet colorant. The microwave dryer further includes a microwave waveguide electromagnetically coupled to the microwave source that transports the electromagnetic energy between a first end and a second end. The microwave waveguide includes a passageway that is sized to pass the continuous-form print medium through the microwave waveguide. The microwave dryer further includes a plurality of microwave absorbing elements disposed within the microwave waveguide that absorb the electromagnetic energy and heat the wet colorant.

Another embodiment comprises a method of fabricating a microwave dryer that dries a wet colorant applied to a continuous-form print medium by a printing system. The method comprises activating a microwave source that generates electromagnetic energy to dry the wet colorant, where the microwave source is electromagnetically coupled to a microwave waveguide that includes a passageway that is sized to pass the continuous-form print medium through the microwave waveguide. The method further includes measuring radio frequency levels of the electromagnetic energy within the microwave waveguide at a plurality of locations along a media path of the continuous-form print medium, and positioning a plurality of microwave absorbing elements within the microwave waveguide based on the radio frequency levels.

Another embodiment comprises a printing system that includes a printer and a microwave dryer. The printer applies a wet colorant to a continuous-form print medium, and the microwave dryer receives the continuous-form print medium from the printer. The microwave dryer includes a microwave source that generates electromagnetic energy to dry the wet colorant, and a microwave waveguide. The microwave waveguide is electromagnetically coupled to the microwave source, and includes a passageway that is sized to pass the continuous-form print medium through the microwave waveguide. The microwave dryer further includes a plurality of microwave absorbing elements disposed within the microwave waveguide that absorb the electromagnetic energy and heat the wet colorant in conjunction with the electromagnetic energy.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
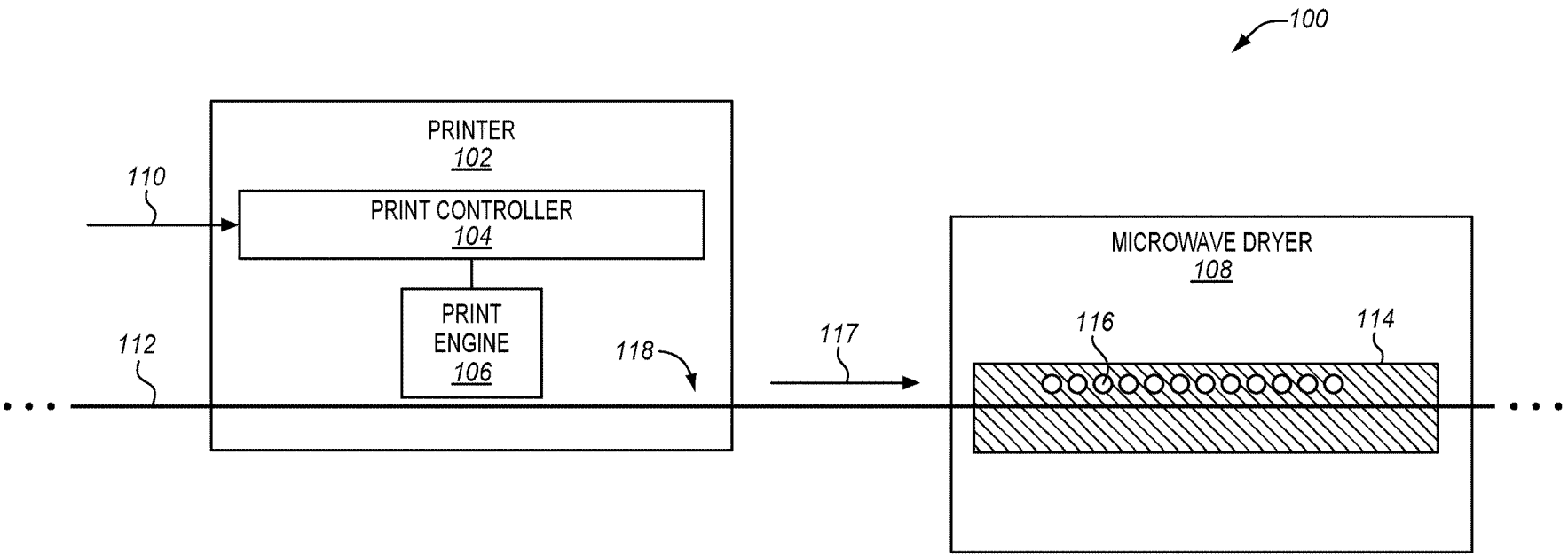
FIG. 1 is a block diagram of a printing system in an exemplary embodiment.

FIG. 1 is a block diagram of a printing system 100 in an exemplary embodiment. FIG. 1 also illustrates a print medium 112 (e.g., a continuous-form or cut-sheet print medium) that is marked by printing system 100 with a wet or liquid colorant. Some examples of wet or liquid colorants includes aqueous inks. Some examples of print medium 112 include paper, textile, and other printable planar materials. Print medium 112 travels along a media path 117 in FIG. 1.

In this embodiment, printing system 100 includes a printer 102 and a microwave dryer 108. Printer 102 applies a wet colorant to a top surface 118 of print medium 112, which is then dried by microwave dryer 108. In printing system 100, a print controller 104 of printer 102 receives print data 110 for imprinting onto print medium 112, which is rasterized by print controller 104 into bitmap data. The bitmap data is used by a print engine 106 (e.g., a drop-on-demand print engine) of printer 102 to apply wet colorants to print medium 112, which then travels downstream of printer 102 to microwave dryer 108. Microwave dryer 108 applies electromagnetic energy 114 (e.g., microwave energy) to print medium 112, which heats the wet colorants applied to print medium 112 by electromagnetic heating (i.e., dielectric heating) to evaporate a liquid portion of the wet colorants. This fixes the wet colorants to print medium 112. Printer 102, print controller 104, print engine 106, and microwave dryer 108 may be separate devices or incorporated with one another in various embodiments.

In high-speed production printing systems, the speed of the print medium through a microwave waveguide can make it difficult to maintain a sufficient exposure time of the print medium to the microwave energy without increasing the length of the microwave waveguide and/or increasing the amount of microwave power applied to the print medium by the microwave source. However, increasing the length of the microwave waveguide increases the length of the microwave dryer, and increasing the microwave power applied to the print medium uses more electrical power.

In printing system 100, microwave dryer 108 utilizes a plurality of microwave absorbing elements 116 to increase the drying capability of microwave dryer 108. Microwave absorbing elements 116 absorb electromagnetic energy 114 (e.g., microwave energy) and become heated. Microwave absorbing elements 116 may have a diameter of between 5 millimeters and 10 millimeters, and may be round, oval, or some other shape. Microwave absorbing elements 116 are proximate to print medium 112 (e.g., microwave absorbing elements 116 are disposed proximate to a media path through microwave dryer 108). Further, microwave absorbing elements 116 may optionally touch print medium 112 in some embodiments (e.g., microwave absorbing elements 116 may be used as guides for print medium 112 within microwave dryer 108, thereby adding a conductive heating component for drying the wet colorants applied to print medium 112).

Once heated, microwave absorbing elements 116 are able to apply additional heating capability to the wet colorants applied to print medium 112, thereby allowing the length of microwave dryer 108 to be reduced and/or the microwave power applied to print medium 112 to be reduced. Reducing the length of microwave dryer 108 reduces the footprint of printing system 100 on a shop floor of a production printing facility. Reducing the microwave power used by microwave dryer 108 reduces the operating costs of printing system 100.

Figure 2A:
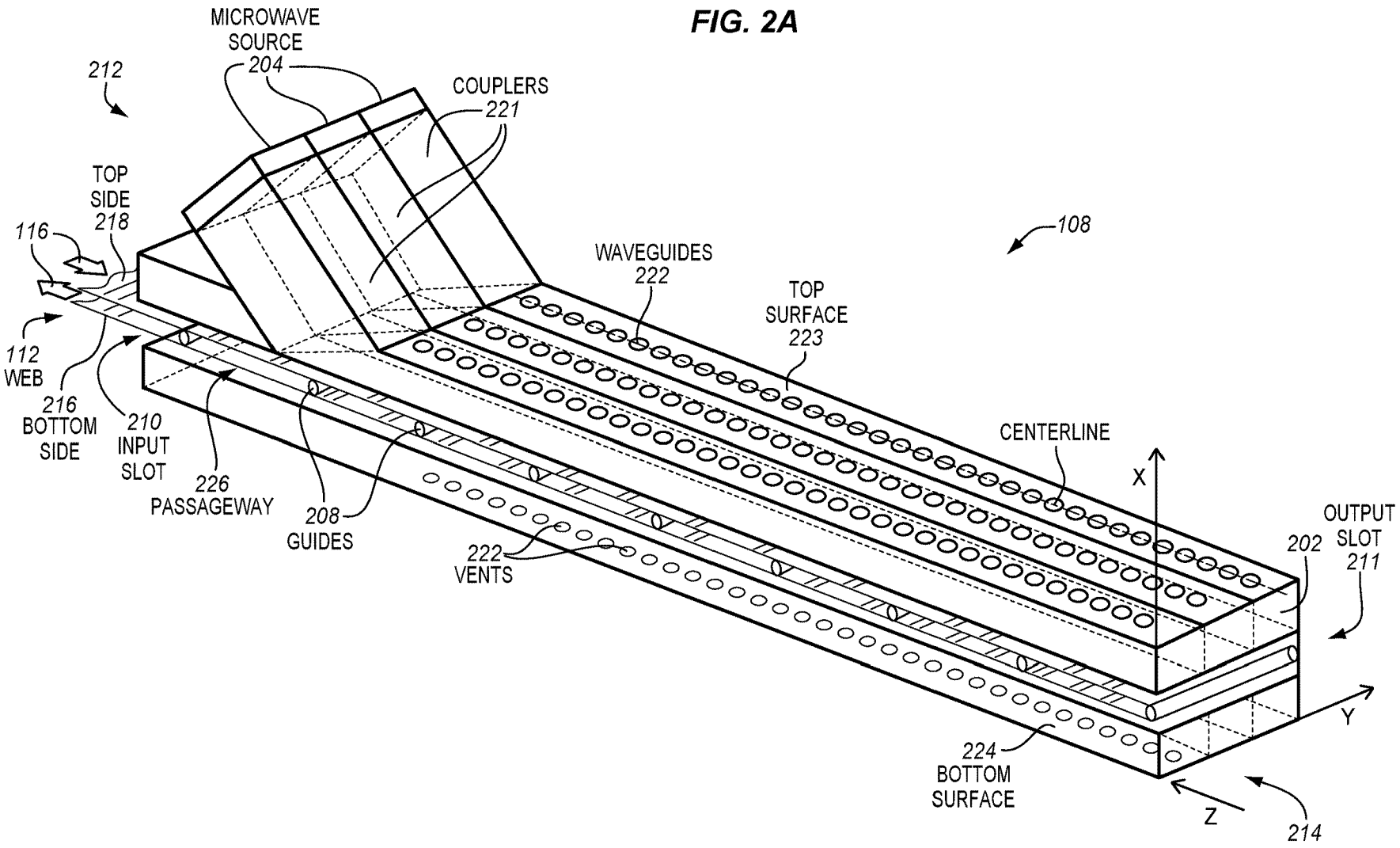
FIG. 2A is a 3-dimensional cross-section of a microwave dryer in an exemplary embodiment.

FIG. 2A is a 3-dimensional cross-section of microwave dryer 108 in an exemplary embodiment. Microwave absorbing elements 116 are not shown in this view. In this embodiment, microwave dryer 108 includes a plurality of waveguides 202 that are electromagnetically coupled to microwave sources 204 via couplers 221 (e.g., a 2.4 Gigahertz microwave source). Although waveguides 202 are illustrated in a horizontal configuration in FIG. 2A, waveguides 202 may be oriented vertically to further reduce a horizontal footprint of microwave dryer 108. In this embodiment, microwave sources 204 inject electromagnetic energy 114 into waveguides 202, which heats the wet colorants applied to print medium 112 while print medium 112 is within waveguides 202. As shown, a plurality of waveguides 202 are positioned adjacent to each other lengthwise. Waveguides 202 on the ends across the width of print medium 112 are not shown in FIG. 2A for illustrative purposes.

Figure 2B:
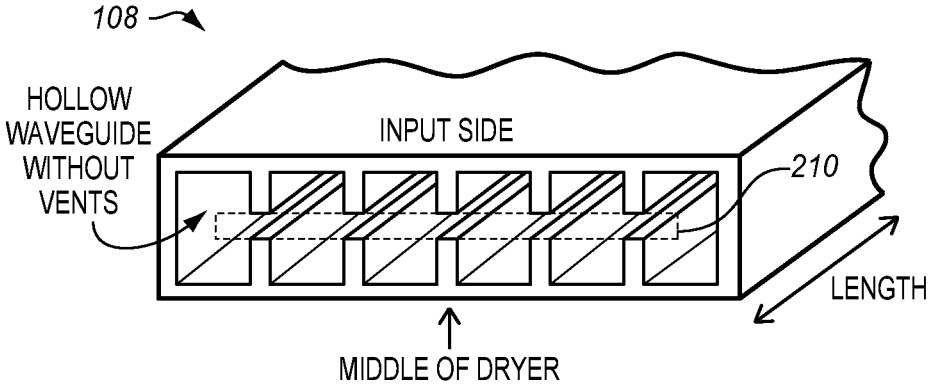
FIG. 2B is an end view of the microwave dryer of FIG. 2A in an exemplary embodiment.
Figure 2C:
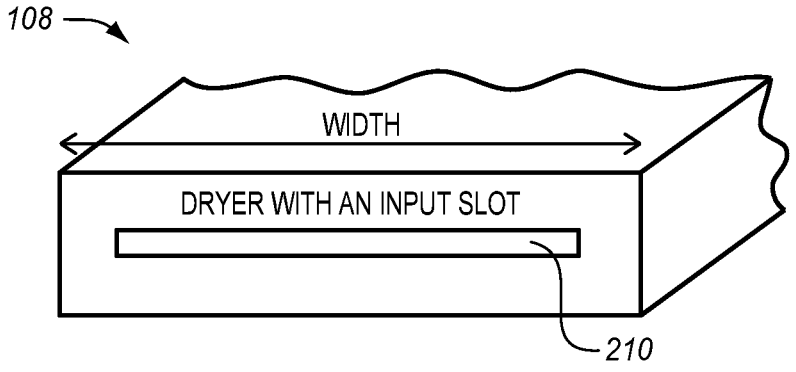
FIG. 2C is another end view of the microwave dryer of FIG. 2A in an exemplary embodiment.

In this embodiment, an input slot 210 at a first end 212 of waveguides 202 is sized to accept print medium 112, and to pass print medium 112 into waveguides 202. For example, input slot 210 may be sized to have about same width as print medium 112, and a height that varies depending on the frequency of electromagnetic energy 114. For a 2.4 Gigahertz microwave source, input slot 210 may have a height that is about 1 to 1.5 centimeters. In this embodiment, an output slot 211 at a second end 214 of waveguides 202 is sized to accept print medium 112, and to pass print medium 112 out of waveguides 202. A passageway 226 extends through waveguides 202 between input slot 210 and output slot 211. Passageway 226 is sized to accept print medium 112, and allow print medium 112 to traverse through microwave dryer 108 and at least one of waveguides 202. The number of waveguides 202 is selected to accommodate a width of passageway 226 such that the outer side walls of microwave dryer 108 do not include passageway 226. FIG. 2B and FIG. 2C are end views of microwave dryer 108 of FIG. 2A in an exemplary embodiment, and illustrate input slot 210. FIG. 2B illustrates waveguides 202 located on the ends across the width of print medium 112.

In some embodiments, waveguides 202 may include vents 222 in a top surface 223 and a bottom surface 224 of waveguides 202, which can be used to provide airflow through the interiors of waveguides 202.

In some embodiments, microwave dryer 108 may include a plurality of guides 208 that are disposed within waveguides. Guides 208 are illustrated as circular in FIG. 2A, although guides 208 may be other shapes as desired. Guides 208 are in contact with print medium 112 within waveguides 202 and may be used to prevent print medium 112 from fluttering and/or contacting the interior surfaces of waveguides 202. Contact between print medium 112 and the interior surfaces of waveguides 202 is undesirable, as it may smear or smudge the wet colorants applied to print medium 112 or cause physical damage to print medium 112. In this embodiment, guides 208 are in contact with print medium 112 on a side of print medium 112 (e.g., a bottom side 216) that does not include the wet colorant. For instance, the wet colorant may be applied to a top side 218 of print medium 112. Guides 208 may include rods (e.g., glass rods), rollers (e.g., TEFLON™ rollers), or combinations of rods or rollers. Further, guides 208 may be formed from materials that are transparent to electromagnetic energy 114. This ensures that guides 208 are not heated by electromagnetic energy 114.

Figure 3:
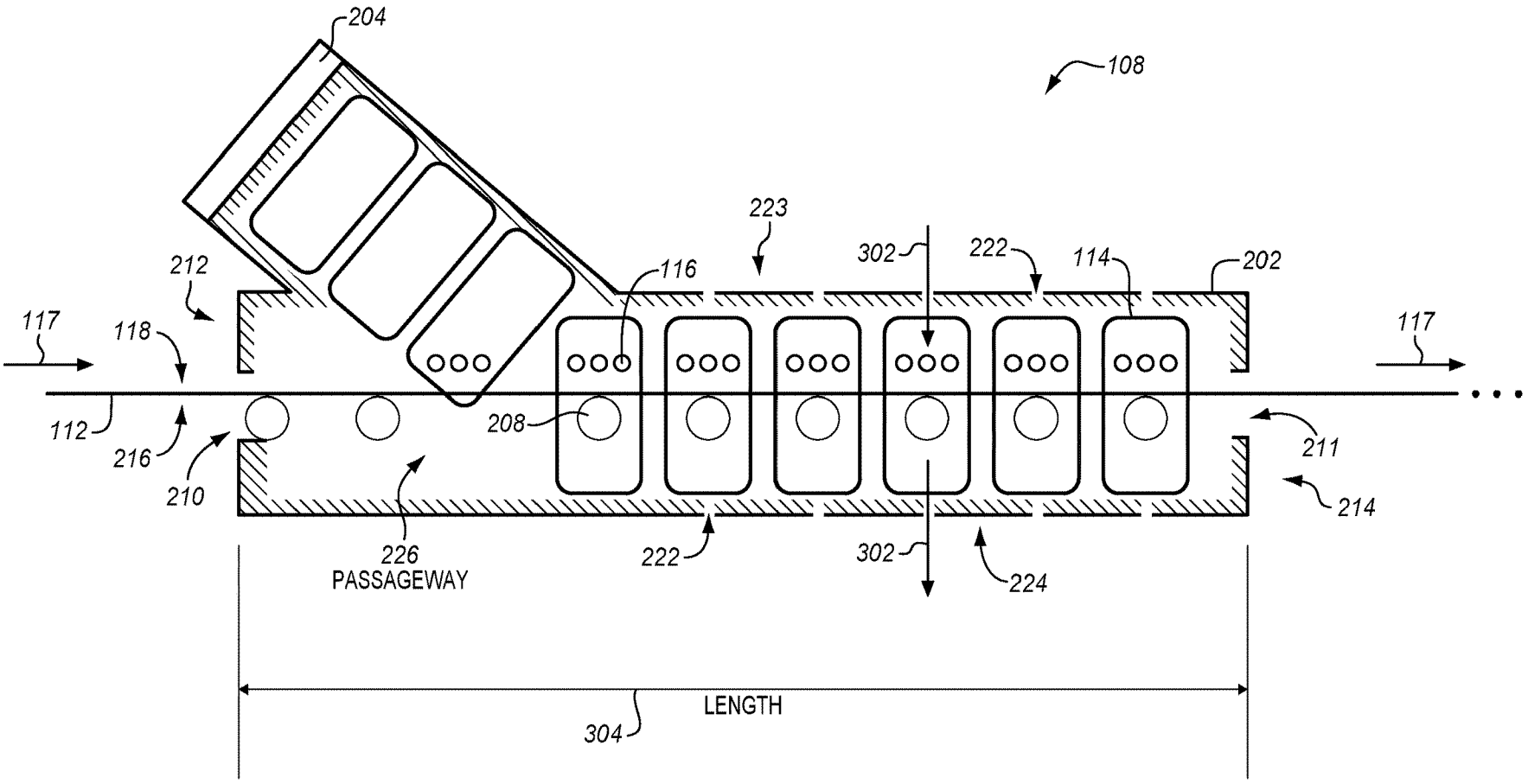
FIG. 3 is a cross-section of one of the waveguides for the microwave dryer of FIG. 2A in an exemplary embodiment.

FIG. 3 is a cross-section of one of the waveguides 202 of FIG. 2A in an exemplary embodiment. In this embodiment, waveguide 202 further includes microwave absorbing elements 116, which are located within waveguide 202. Microwave absorbing elements 116 may traverse across a width of media path 117 in some embodiments (e.g., microwave absorbing elements 116 traverse a width of print medium 112, which is into the page in FIG. 3). Microwave absorbing elements 116 are formed from a material that absorbs electromagnetic energy 114. For instance, microwave absorbing elements 116 may be formed from carbon, and/or with carbon, and/or from materials that are doped with carbon (e.g., glass rods doped with carbon). The carbon absorbs electromagnetic energy 114, which causes microwave absorbing elements 116 to heat. As print medium 112 travels through waveguide 202 along media path 117, microwave absorbing elements 116, now heated, also heat the wet colorant applied to print medium 112 (e.g., using thermal radiative heating). The heating of the wet colorant is in addition to the electromagnetic heating provided by electromagnetic energy 114 to the wet colorant as print medium 112 traverses from input slot 210 at first end 212 of waveguide 202, along passageway 226, and out of output slot 211 at second end 214 of waveguide 202. Although a particular location and number of microwave absorbing elements 116 are illustrated in FIG. 3, the location and/or the number of microwave absorbing elements 116 may vary as a matter of design choice.

In FIG. 3, electromagnetic energy 114 is illustrated within waveguide 202 as a plurality of rectangular features that represent a standing wave. Within the rectangular features, the standing wave of electromagnetic energy 114 forms Radio Frequency (RF) peaks in the RF levels for electromagnetic energy 114. For instance, within the rectangular features, the RF level may be high while in between the rectangular features, the RF levels may be at lower RF level. In FIG. 3, microwave absorbing elements 116 are positioned proximate to the peaks in RF levels outlined by the standing wave illustrated in FIG. 3, although microwave absorbing elements 116 may be positioned within waveguide 202 at alternative locations as a matter of design choice. When microwave absorbing elements 116 are located proximate to peaks in the RF levels of electromagnetic energy 114, microwave absorbing elements 116 become more heated for the same overall RF power supplied by microwave source 204 than if microwave absorbing elements 116 were located at locations within waveguide 202 where the RF levels were lower. For instance, if microwave absorbing elements 116 were located between the rectangular features illustrated in FIG. 3, then microwave absorbing elements 116 would receive less of electromagnetic energy 114.

In some embodiments, waveguide 202 may include a plurality of vents 222 in top surface 223 and/or bottom surface 224, which allows an airstream 302 to be provided to microwave absorbing elements 116. Microwave absorbing elements 116 heat the air, which is then provided to the wet colorant applied to top surface 118 of print medium 112 to help facilitate drying of the wet colorant. This may also further improve the drying capabilities of microwave dryer 108. When the air is heated by microwave absorbing elements 116 rather than by an external source (e.g., electric heaters), the electrical efficiency of microwave dryer 108 may be improved. The number of locations of vents 222 illustrated in FIG. 3 may vary as a matter of design choice. Further, airstream 302 may be provided through vents 222 in top surface 223 and/or bottom surface 224 of waveguide 202 as a matter of design choice.

Airstream 302 impinges upon the wet colorant applied to print medium 112, which causes a liquid portion of the wet colorant to evaporate. Airstream 302 is exhausted from the interior of waveguide 202 by, for example, vents 222 in bottom surface 224 of waveguide 202.

Figure 4:
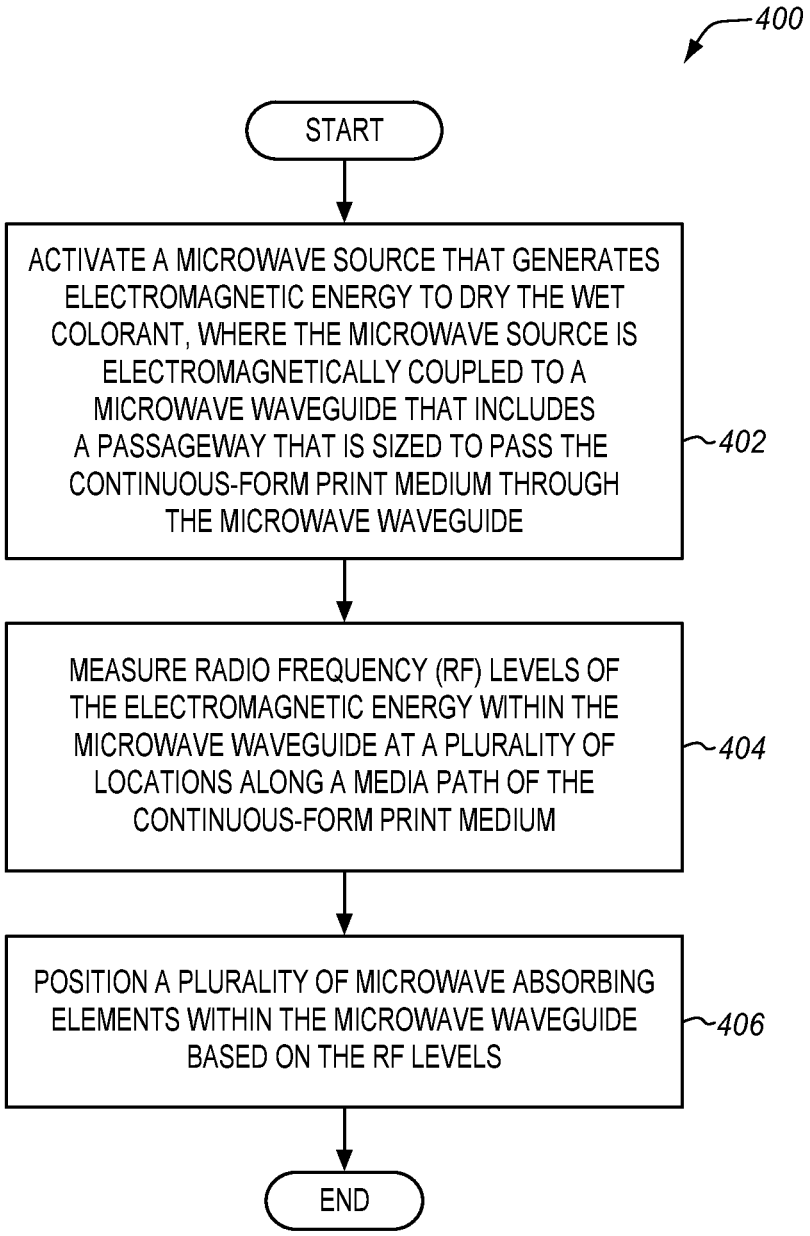
FIG. 4 is a flow chart of a method of fabricating the microwave dryer of FIG. 2A in an exemplary embodiment.

FIG. 4 is a flow chart of a method 400 of fabricating a microwave dryer in an exemplary embodiment. Method 400 will be described with respect to printing system 100 and microwave dryer 108, although method 400 may apply to other microwave dryers and waveguide configurations that are not shown. The steps illustrated for method 400 are not all inclusive, and may include other steps not shown. Also, the steps may be performed in an alternate order.

In some cases, the peaks in RF levels for electromagnetic energy 114 within waveguide 202 can vary depending on the fabrication tolerances for waveguide 202, the materials used to fabricate waveguide 202, whether guides 208 are present in waveguide 202, etc. Thus, it may be difficult to predetermine the locations of microwave absorbing elements 116 within waveguide 202 using RF models of waveguide 202. Therefore, RF measurements may be made after waveguide 202 is fabricated to determine the RF levels within waveguide 202. To do so, microwave source 204 is activated, which supplies electromagnetic energy 114 to waveguide 202 (see step 402 of FIG. 4). RF levels (e.g., RF power levels) of electromagnetic energy 114 are measured at a plurality of locations along media path 117 within waveguide 202 (see step 404). For example, an RF probe may be inserted within waveguide 202, and moved along a length 304 of waveguide 202 along media path 117. At different locations along waveguide 202, RF levels are measured. Often the RF levels will vary along media path 117 through waveguide 202 as standing waves of electromagnetic energy 114 are formed within waveguide 202. Thus, it would be expected that the RF levels would rise and fall in a pattern along media path 117 through waveguide 202. Although the RF levels may be measured within waveguide 202, other possibilities exist for measuring the RF levels across length 304 of waveguide 202 (e.g., along media path 117). Based on the measured RF levels, microwave absorbing elements 116 are positioned within waveguide 202 (see step 406). For instance, microwave absorbing elements 116 may be positioned at peaks in the RF levels, may be positioned proximate to the RF peaks, etc.

The use of microwave absorbing elements 116 further increases the drying capability of microwave dryer 108, thereby allowing for a reduction in the power applied by microwave source 204 and/or a possible reduction in length 304 of waveguide 202. The further addition of an impinging airstream 302 upon microwave absorbing elements 116 can provide a convective-heating component in addition to the electromagnetic heating component provided by electromagnetic energy 114 and the thermal radiative heating component provided by microwave absorbing elements 116.

Although specific embodiments were described herein, the scope of the invention is not limited to those specific embodiments. The scope of the invention is defined by the following claims and any equivalents thereof.

What is claimed is:

1. An apparatus, comprising:

a microwave waveguide configured to transport electromagnetic energy between a first end and a second end, wherein the microwave waveguide includes a passageway that is sized to pass a medium through the microwave waveguide; and a plurality of microwave absorbing elements disposed within the microwave waveguide and proximate to the passageway that are configured to absorb the electromagnetic energy, and to heat the medium, wherein the plurality of microwave absorbing elements are positioned based on radio frequency levels of the electromagnetic energy within the microwave waveguide.

2. The apparatus of claim 1, wherein:

the plurality of microwave absorbing elements are positioned to be proximate to peaks in radio frequency levels of the electromagnetic energy within the microwave waveguide.

3. The apparatus of claim 1, wherein:

the plurality of microwave absorbing elements are doped with carbon.

4. The apparatus of claim 3, wherein:

the plurality of microwave absorbing elements comprise glass rods doped with carbon, wherein the glass rods traverse across a width of a media path of the medium through the microwave waveguide.

5. The apparatus of claim 1, further comprising:

a plurality of guides disposed within the microwave waveguide that are configured to contact the medium on a side of the medium that does not include a wet colorant.

6. The apparatus of claim 5, wherein:

the plurality of guides comprises rods, rollers, or combinations of the rods and the rollers.

7. The apparatus of claim 6, wherein:

the plurality of guides comprises a material that is transparent to the electromagnetic energy.

8. The apparatus of claim 1, wherein:

the microwave waveguide includes a plurality of air inlets that are configured to provide an air stream that is proximate to the plurality of microwave absorbing elements.

9. A method, comprising:

activating a microwave source that generates electromagnetic energy, wherein the microwave source is electromagnetically coupled to a microwave waveguide that includes a passageway that is sized to pass a medium through the microwave waveguide;

measuring radio frequency levels of the electromagnetic energy within the microwave waveguide at a plurality of locations along a media path of the medium through the microwave waveguide; and positioning a plurality of microwave absorbing elements within the microwave waveguide based on the radio frequency levels.

10. The method of claim 9, wherein positioning the plurality of microwave absorbing elements further comprises:

positioning the plurality of microwave absorbing elements within the microwave waveguide based on peaks in the radio frequency levels of the electromagnetic energy within the microwave waveguide.

11. A printing system, comprising:

a printer configured to apply a colorant to a medium; and a microwave dryer configured to receive the medium from the printer, the microwave dryer comprising:

a microwave waveguide that includes a passageway that is sized to pass the medium through the microwave waveguide; and a plurality of microwave absorbing elements disposed within the microwave waveguide and proximate to the passageway that are configured to absorb electromagnetic energy, and to heat the colorant in conjunction with the electromagnetic energy.

12. The printing system of claim 11, wherein:

the plurality of microwave absorbing elements are positioned based on radio frequency levels of the electromagnetic energy within the microwave waveguide.

13. The printing system of claim 12, wherein:

the plurality of microwave absorbing elements are positioned to be proximate to peaks in radio frequency levels of the electromagnetic energy within the microwave waveguide.

14. The printing system of claim 13, wherein:

the plurality of microwave absorbing elements are doped with carbon.

15. The printing system of claim 14, wherein:

the plurality of microwave absorbing elements comprise glass rods doped with carbon, wherein the glass rods traverse a width of a media path of the medium through the microwave waveguide.

16. The printing system of claim 11, wherein the microwave dryer further comprises:

a plurality of guides disposed within the microwave waveguide that are configured to contact the medium on a side of the medium that does not include the colorant.

17. The printing system of claim 16, wherein:

the plurality of guides comprises rods, rollers, or combinations of the rods and the rollers.

18. The printing system of claim 17, wherein:

the plurality of guides comprises a material that is transparent to the electromagnetic energy.

19. The printing system of claim 11, wherein:

the microwave waveguide includes a plurality of air inlets that are configured to provide an air stream to the plurality of microwave absorbing elements.

20. The apparatus of claim 1, wherein the microwave absorbing elements traverse a width of the medium.

21. An apparatus, comprising:

a microwave waveguide configured to transport electromagnetic energy between a first end and a second end, wherein the microwave waveguide includes a passageway that is sized to pass a medium through the microwave waveguide;

a plurality of microwave absorbing elements disposed within the microwave waveguide and proximate to the passageway that are configured to absorb the electromagnetic energy, and to heat the medium; and a plurality of guides disposed within the microwave waveguide that are configured to contact the medium on a side of the medium that does not include a wet colorant.

22. The apparatus of claim 21, wherein:

the plurality of guides comprises rods, rollers, or combinations of the rods and the rollers.

* * * * *